US005289755A

United States Patent [19]

Zielinski et al.

[11] Patent Number: 5,289,755

[45] Date of Patent: Mar. 1, 1994

[54] RAM HEAD

[75] Inventors: Erich Zielinski, Dusseldorf; Adolf Nordmann, Erkrath; Jochen Hoff, Düsseldorf, all of Fed. Rep. of Germany

[73] Assignee: Rheinmetall GmbH, Ratingen, Fed. Rep. of Germany

[21] Appl. No.: 964,907

[22] Filed: Oct. 22, 1992

[30] Foreign Application Priority Data

Oct. 25, 1991 [DE] Fed. Rep. of Germany ..... 4135273

[51] Int. Cl.[5] ..... F41A 9/39

[52] U.S. Cl. ..... 89/47; 42/25

[58] Field of Search ..... 89/47, 33.05; 42/25

[56] References Cited

U.S. PATENT DOCUMENTS

| | | | |
|---|---|---|---|
| 1,672,540 | 6/1928 | Page | 42/25 |
| 3,161,978 | 12/1964 | O'Brien et al. | 42/25 |
| 3,477,162 | 11/1969 | Morse . | |
| 3,906,651 | 9/1975 | Vesamaa | 42/25 |
| 4,272,902 | 6/1981 | Waters | 42/25 |
| 4,674,396 | 6/1987 | Pongratz et al. | 89/47 |

FOREIGN PATENT DOCUMENTS

| | | | |
|---|---|---|---|
| 123772 | 4/1919 | United Kingdom . | |
| 308025 | 3/1929 | United Kingdom | 89/47 |

*Primary Examiner*—Stephen M. Johnson

*Attorney, Agent, or Firm*—Spencer, Frank & Schneider

[57] ABSTRACT

A ram head for possibly two-part ammunition which is provided at its bottom with a central rotationally symmetrical form-locking zone. In order to be able to unload the ammunition, a housing (1) is provided with a ring (11) that is arranged to be axially displaceable therein and is provided with a plurality of radially pivotally articulated extraction levers (12), with the extraction levers (12) being spreadable against a spring bias by a plunger (25). The ring is coupled with a slide sleeve (22) that is provided with a centering ring (23) having a shape corresponding to the form locking zone of the ammunition and the axial movement of the ring (11) and of the plunger (25) is controllable by an eccentric shaft (8) mounted on the housing.

11 Claims, 4 Drawing Sheets

RAM HEAD

REFERENCE TO RELATED APPLICATIONS

This application claims the priority of Federal Republic of Germany application Ser. No. P 41 35 273.4, filed Oct. 25, 1991.

BACKGROUND OF THE INVENTION

The present invention relates to a ram head for possibly two part ammunition which at its bottom is provided with a central, rotationally symmetrical form locking zone whereby the ram head can be utilized for extracting the ammunition if desired.

Ram heads are employed in large caliber guns to ram the ammunition that has been supplied to the gun either manually or automatically into the gun barrel up to a collar provided at the casing bottom of the ammunition unit. The removal of the casing or casing bottom (stub casing) after firing from the gun barrel is effected by way of a separate casing ejector having ejector claws which engage the collar of the casing bottom, which after firing is disposed at a distance from the end of the gun barrel.

If, because of a misfire or an order to unload, the ammunition must be removed again from the gun barrel without having been fired, it would be expedient to have an appropriate extraction device that is able to engage the casing bottom of the ammunition (for which the known casing ejector is not suitable since the collar of the casing bottom lies firmly against the end of the gun barrel) so as to prevent the ammunition from having to be ejected toward the rear by a rod or the like inserted into the muzzle of the gun barrel. A rotationally symmetrical form-locking zone disposed on the ammunition components would be suitable for extraction or unloading.

SUMMARY OF THE INVENTION

It is an object of the present invention to provide a ram head for ammunition provided at its bottom with a central rotationly symmetrical form locking zone which simultaneously is configured as an extraction device for pulling ammunition out of a gun barrel and is simple in structure and operation.

The above object is generally achieved according to the present invention by a form locking ram head which comprises: a cylindrical housing having a front end plate and a rear end plate; a ring disposed in the housing for axial displaceable; a plurality of extraction levers which are symmetrically disposed about a longitudinal axis of the housing, which are radially pivotally articulated to the ring, and which extend from the ring toward the front end plate; first spring bias means disposed in the housing for normally biasing the levers in a direction toward the longitudinal axis of the housing; a plunger mounted for axial movement within the housing independently of axial movement of the ring, with the plunger engaging the levers and spreading same when the plunger and the ring are in first axial positions; second spring bias means disposed in the housing for biasing the plunger and the ring toward the rear end plate and into the first axial positions; a slide sleeve coupled to the ring for axial movement therewith, with the slide sleeve being provided with a centering ring into which a front portion of the levers extends, and with the centering ring having a shape to matingly engage in the form locking zone in the bottom of an ammunition unit and extending out of said housing via an opening in the front end plate when the ring is in a second axial position; and, an eccentric shaft rotatably mounted on the housing in a direction transverse to the housing longitudinal axis for controlling the axial movements of the ring and of the plunger.

According to further features of the invention, the ring is rotationally secured in the housing with the slide sleeve and is connected with the slide sleeve by an outer holding ring that is spring biased against the eccentric shaft by the second spring bias means; the first spring bias means comprises respective springs which are guided in respective radial bores in the slide sleeve and which inwardly bias the respective extraction levers relative to the holding ring; and the plunger is spring biased by an axially extending spring, one end of the axially extending spring is supported by a fixed supporting plate, and each of the levers is provided with a tab which engages and forms a friction lock with the supporting plate in response to a large extraction force, and which is engaged by the plunger to cause spreading of the levers.

According to the preferred embodiment of the invention the eccentric shaft has respective cams for axially moving the plunger and the ring, and three detent positions in which (a) the extraction levers and the slide sleeve are positioned inside of the housing with the levers spread, (b) the extraction levers are spread and not in the gripping and the centering ring of the slide sleeve and the extraction levers extend axially at least partially out of the housing at its front end, and (c) the centering ring of the slide sleeve and the levers extend at at least partially out of the housing at its front end and the extraction levers are unspread and in a gripping position.

Finally, according to a still further feature of the invention the housing may be provided with slide rails which extend in the axial direction and are disposed at least at an underside of the housing, with these slide rails preferably being spring biased radially outwardly so that they can be pressed inwardly against a spring bias.

The invention will be described below in greater detail with reference to an embodiment thereof that is illustrated in the attached drawing figures.

BRIEF DESCRIPTION OF THE PREFERRED EMBODIMENTS

DETAILED DESCRIPTION OF THE PREFERRED EMBODIMENTS

Figure 1:
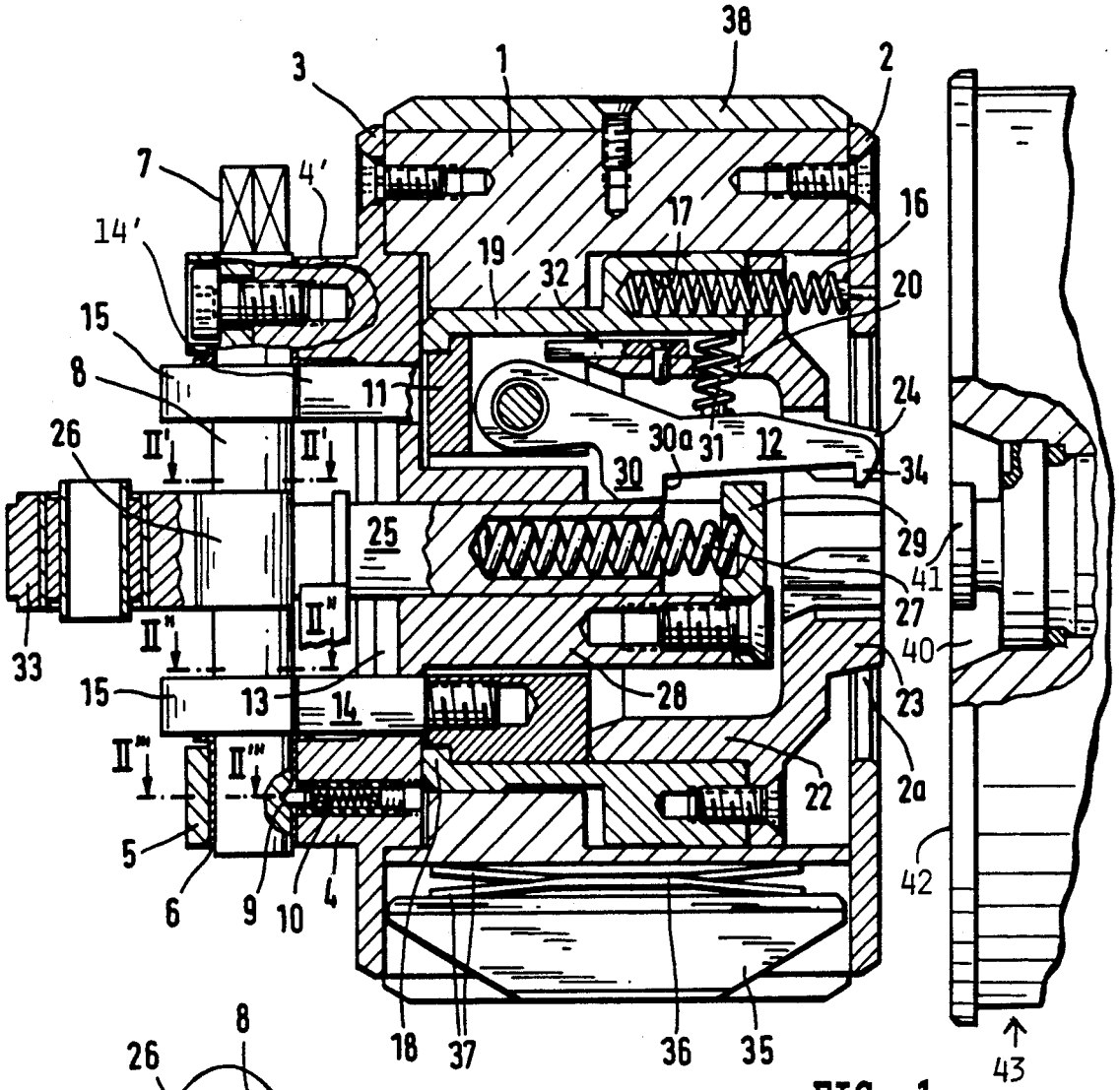
FIG. 1 is an axial sectional view of a ram head according to the invention in its starting position.

The ram head in the figures includes a cylindrical housing 1 to which is fastened or screwed a front end plate 2 and a rear end plate 3, both having an annular configuration. The rear end plate 3 has two rearwardly oriented longitudinally directed extensions 4, 4' each of which, together with respective holding members 5, 5' screwed to the associated extensions 4, 4', accommodates a respective transversely extending sleeve bearing 6, 6'. Bearing sleeves 6, 6' serve to support an eccentric shaft 8 which extends transverse to the longitudinal direction and is provided with a hexagonal stub 7 at one end for the purpose of rotating the shaft. In the region of extension 4, the eccentric shaft 8 is provided with three detent notches 9 that are distributed uniformly about its circumference at an angular spacing of 120° (see FIG. 2c for example). The associated extension 4 accommodates a longitudinally extending pressure member 10 that is spring biased in the direction toward the detent notches 9 and thus holds the eccentric shaft 8 in a locking engagement in one of the three positions determined by the particular one of the detent notches 9 into which member 10 moves due to rotation of the eccentric shaft via its hexagonal stub 7.

A ring 11 is disposed in housing 1 so as to be longitudinally displaceable. Three extraction levers 12 (only one of which is shown) are mounted at angular intervals of 120° along ring 11 so as to be pivotal in the radial direction, i.e., toward and away from the longitudinal axis of housing 1, and extending from the ring 11 toward the front end plate 2. Ring 11 is provided with two pins 14, 14' that are oriented longitudinally toward the rear and project through openings 13 in the rear end plate 3. These pins 14, 14' are in engagement with respective similarly shaped cams or cam surfaces 15, 15' on the eccentric shaft 8. Ring 11 is arranged in housing 1 so as to be secured against rotation by pins 14, 14'.

The cams 15, 15' serve to displace ring 11 and its extraction levers 12 in the axial direction of housing 1 against the force of axially or longitudinally extending springs 16 which, on the one hand, are supported at the front end plate 2 and, on the other hand, are received in part by respective longitudinally extending bores 17 in a holding ring 19 that extends around and grips the rear surface of the ring 11 by means of an internal flange 18 (see FIG. 1). Holding ring 19 is screwed to a displacement sleeve 22 provided with three radial bores 20 disposed opposite the respective levers 12. This displacement sleeve 22 is provided with a centering ring 23 having a frustoconical peripheral shape that can be brought into mating engagement with a corresponding frustoconical annular recess 40 surrounding a central, rotationally symmetrical form locking zone or pin 41 in the bottom 42 of the casing portion 43 of an ammunition unit that is to be extracted from the associated gun barrel. Centering ring 23 is provided with slots 24 for receiving the respective extraction levers 12 and has its frustoconical portion disposed in the region of a central opening 2a in the front end plate 2.

The rear of displacement sleeve 22 is supported at the frontal face or end surface of ring 11, for example by means of screws, so that ring 11, holding ring 19 and displacement sleeve 22 are jointly axially displaceable by the cams 15, 15' and against the bias of the springs 16.

The respective extraction levers 12 can be actuated by a plunger 25 which is displaceable against the force of a spring 27 along the longitudinal axis of the extraction head by a further cam 26 on the eccentric shaft 8. Plunger 25 is here guided in a corresponding housing bore of a central, forwardly oriented, inner housing extension 28 of rear end plate 3, to which a forward supporting plate 29 for spring 27 is fastened. Each of the extraction levers 12 is provided with a respective radially inwardly oriented tab 30 that is sloped forwardly on its side facing eccentric shaft and is radially inwardly biased by a respective spring 31 that is supported in the associated respective radial bore 20 so that tabs 30 are possibly in engagement with the surface of plunger 25 which, if in the corresponding position, spreads extraction levers 12 against the bias of springs 31. The supporting plate 29 also serves as a stop to limit the inward pivoting movement of extraction levers 12 under the action of springs 3 in the non-spread state. If, for example, the extraction force becomes greater than the tensioning force of springs 16 when the components are jammed in, the tabs 30a of extraction levers 12 place themselves against supporting plate 29 and thus prevent unintentional opening of extraction levers 12 against the force of supporting springs 31. The ram head is provided with a guard against twisting 32 between the ring 11 and the displacement sleeve 22, and further includes a bar 33 for connection of the ram head to a ram chain or the like.

Figure 2A:
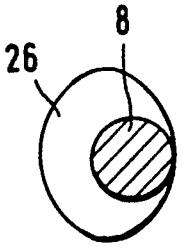
FIGS. 2a–2c are cross-sectional views, in the directions II′—II′, II″—II″, and II‴—II‴, respectively, of FIG. 1, showing the associated positions in various planes of an eccentric shaft of the ram head in the starting position.
Figure 2B:
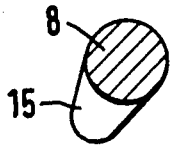
Figure 2C:
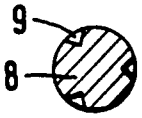

FIG. 1 shows the ram head in its starting position, i.e. the 0° position of the eccentric shaft 8 of FIGS. 2a–2c.

In this position, the displacement sleeve 22 and the holding ring 19 are moved inwardly by the springs 16 so that the end surface of the centering ring 23 is flush with the outer surface of the front end plate 2. In this position the extraction levers 12 are also in their engaged or spread position, with the tabs 30 lying against the surface of plunger 25 so that extraction levers 12 are simultaneously spread apart. As can be seen in FIGS. 2a and 2b the cams 15 and 26 are not urging the ring 19 and the plunger 25 outwardly toward the front end plate 2. In this position, the ram head is employed to ram the ammunition into the gun.

Figure 3:
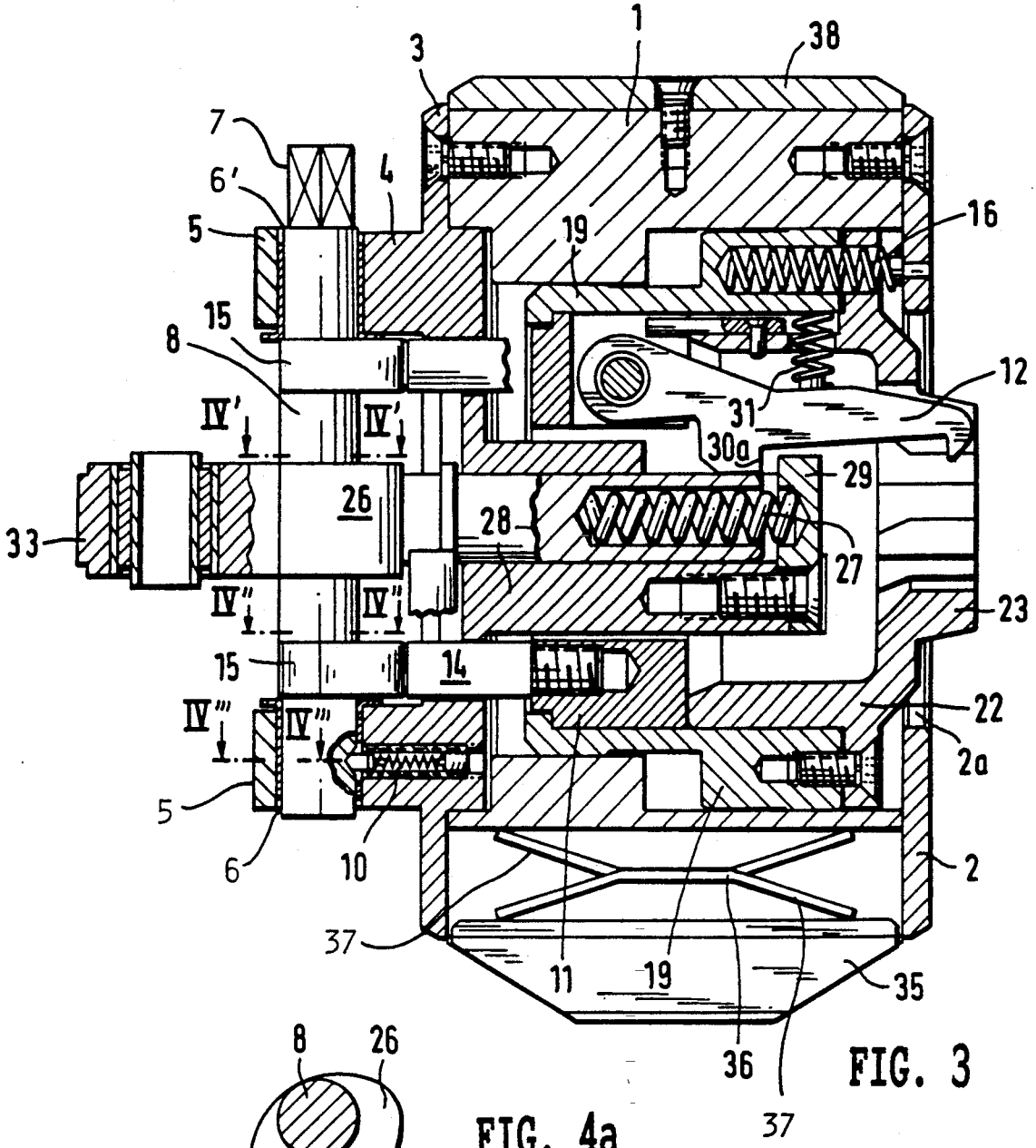
FIG. 3 is an axial sectional view of the ram head of ended position.
Figure 4A:
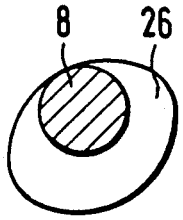
FIGS. 4a–4c are cross-sectional views, in the directions IV′—IV′, IV″—IV″ and IV‴—IV‴, respectively, of FIG. 3, showing the positions of the eccentric shaft of the ram head in the extended position in various planes corresponding to those of FIGS. 2a–2c.
Figure 4B:
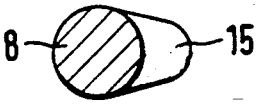
Figure 4C:
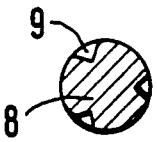

By further rotating eccentric shaft 8 into the next detent position, i.e. the 120° position of eccentric shaft 8 as shown in FIGS. 4a–4c, the ram head is in the condition shown in FIG. 3 in which the cams 15, 15', engage and move the pins 14, 14' to cause the ring 11 and the displacement sleeve 22 to be moved toward the front plate 2 and thus cause the centering ring 23 to project by a predetermined amount beyond the front end surface of plate 2. Additionally, plunger 25 is moved out toward the front by the cam 26 (see FIG. 4a) so that the likewise longitudinally moved out extraction levers 12 continue to be in control with the plunger 25 via the tabs 30 and thus remain spread. In this condition the centering ring 23 may be extended into the recess 40 in the bottom 42 of the casing 43.

Figure 5:
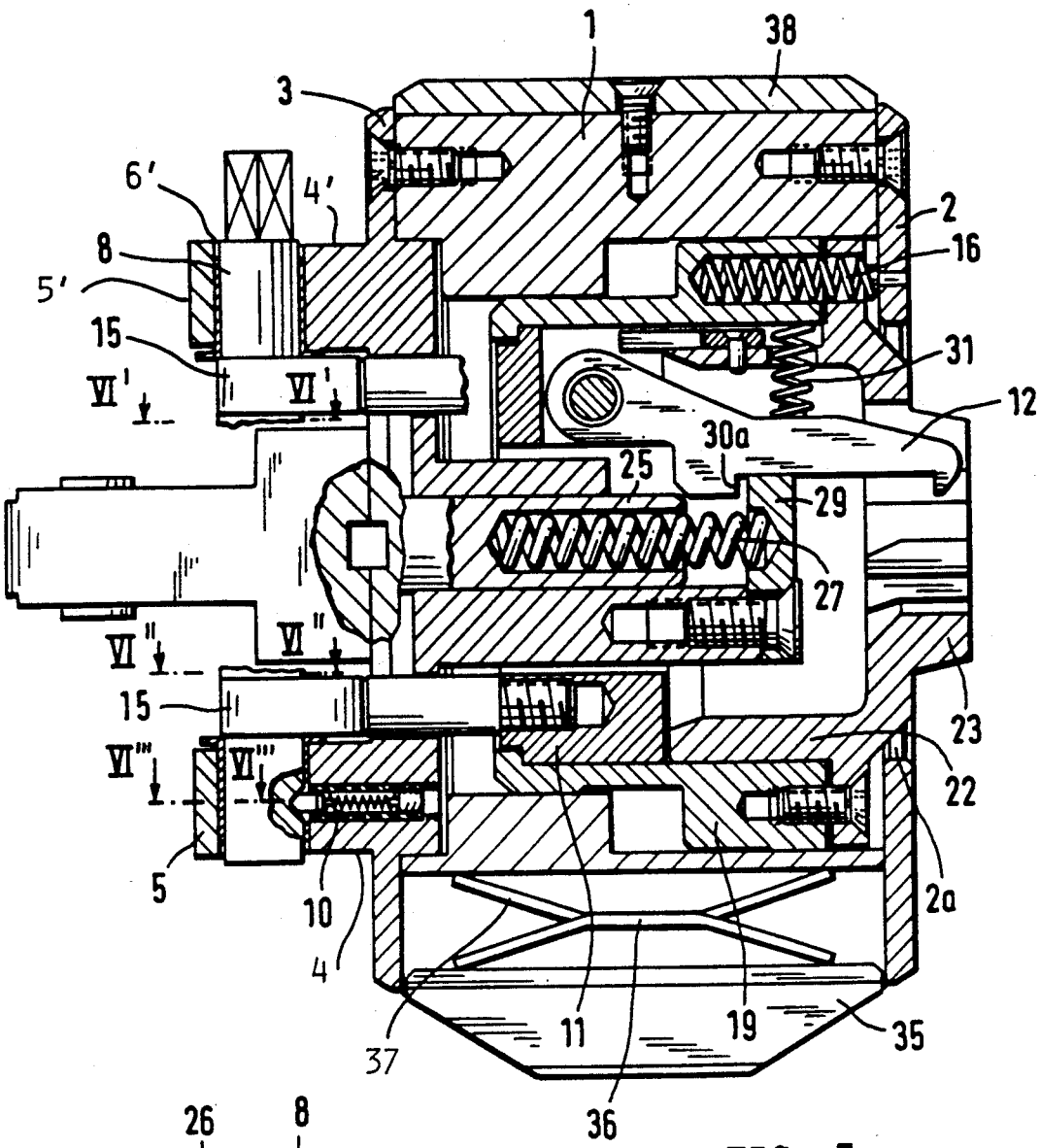
FIG. 5 is an axial sectional view of the ram head of FIG. 1 in the extraction position.
Figure 6A:
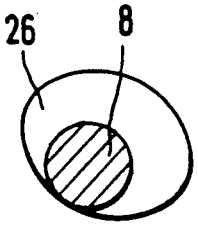
FIGS. 6a–6c are cross-sectional views, in the directions VI′—VI′, VI″—VI″ and VI‴—VI‴, respectively, of FIG. 5, showing the position of the eccentric shaft of the ram head in the extraction position in various planes corresponding to those of FIGS. 2a–2c and 4a–4c.
Figure 6B:
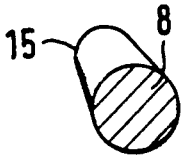
Figure 6C:
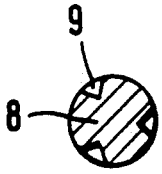
Figure 7:
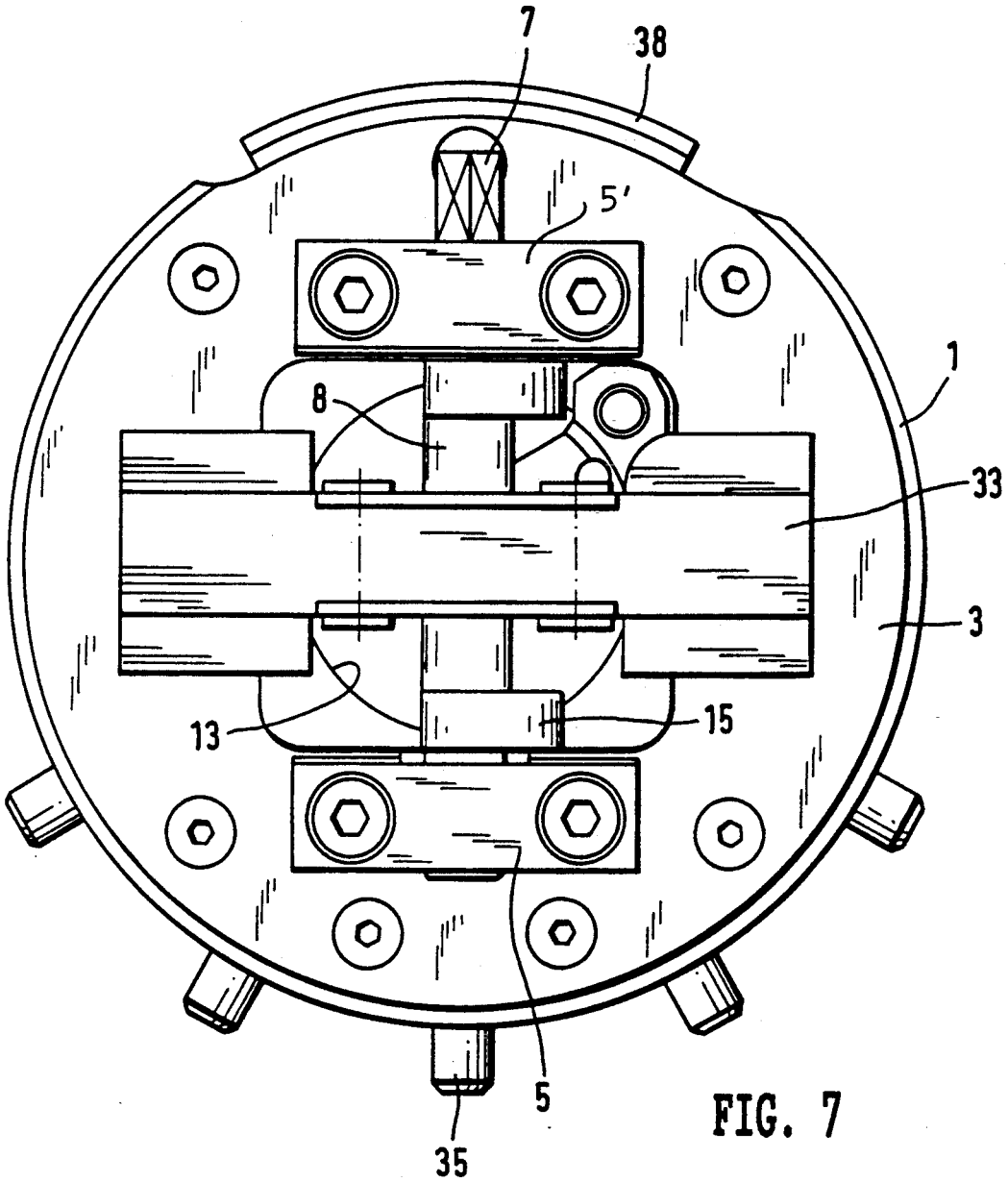
FIG. 7 is a rear view of the ram head of FIG. 1.

By rotating eccentric shaft 8 into its next, i.e. third, detent position, i.e. the 240° position of the eccentric shaft 8 according to FIGS. 6a–6c, the ram head is in the condition shown in FIG. 5 in which plunger 25 has been set back by the force of spring 27 and the corresponding position of cam 26, so that the tabs 30 of the levers 12 are no longer supported on the surface of the plunger 25 and the extended extraction levers 12 move to a radially inwardly pivoted gripping position. In this inwardly pivoted position, the forward inward directed hooks 34 of the respective levers 12 are able to grip behind the corresponding shaped central ring like member 41 in the bottom of the ammunition unit to be extracted. In this position, the ammunition unit, e.g. unit 43, can be pulled out of the gun barrel and can thus be unloaded. After the extraction, the eccentric shaft 8 is returned to its starting position (FIGS. 1 and 2a–2c).

Since the ram head serves, in particular, also to extract two-part ammunition from the gun barrel, the ram head must, if required, also be introduced into the gun barrel in order to extract the front portion of the ammunition. In order to eliminate wear and damage to the gun barrel as much as possible, housing 1, which is of a smaller caliber than the gun barrel in which it is used, is provided at its underside with additional skids 35, possibly made of plastic, which are biased toward the outside by means of respective springs 36. Springs 36 may here be configured as leaf springs which are provided with arms 37 at both their ends that are spread open toward both sides so that skids 35 can be pressed in on one or both ends or sides. However, several screw springs could be used instead for the same purpose. The resiliently mounted skids 35 which, in their snapped in end position as shown in FIG. 1, are approximately flush with the outer diameter of the ram head housing 1, permit adaptation of the ram head to different configurations of loading bridge, loading tray, breechblock and gun barrel.

Additionally, such resiliently mounted skids 35 or a large-area (as shown) plastic slide face 38, or several fixed, somewhat outwardly projecting plastic slide faces 38, may be provided at the top face of housing 1.

The invention now being fully described, it will be apparent to one of ordinary skill in the art that any changes and modifications can be made thereto without departing from the spirit or scope of the invention as set forth herein.

What is claimed is:

1. A ram head for permitting extraction of an ammunition unit which in its bottom is provided with a central, rotationally symmetrical form locking zone, said ram head comprising: a cylindrical housing having a front end plate and a rear end plate; a ring disposed in said housing for axial displacement; a plurality of extraction levers symmetrically disposed about a longitudinal axis of said housing, radially pivotally articulated to said ring and extending toward said front end plate; first spring bias means disposed in said housing for normally biasing said levers in a direction toward the longitudinal axis of said housing; a plunger mounted for axial movement within said housing independently of axial movement of said ring, said plunger engaging said levers and spreading same when said plunger and said ring are in first axial positions; second spring bias means disposed in said housing for biasing said plunger and said ring toward said rear end plate and into said first axial positions; a slide sleeve coupled to said ring for axial movement therewith, said slide sleeve being provided with a centering ring into which a front portion of said levers extend, said centering ring having a shape to matingly engage in the form locking zone in the bottom of the ammunition unit and extending out of said housing via an opening in said front end plate when said ring is in a second axial position; and, an eccentric shaft rotatably mounted on said housing in a direction transverse to said longitudinal axis for controlling the axial movements of said ring and of said plunger.

2. A ram head as defined in claim 1, further comprising means for rotationally securing said ring in said housing and with said slide sleeve.

3. A ram head as defined in claim 2, wherein said ring is connected with said slide sleeve by an outer holding ring that is spring biased towards said eccentric shaft by said second spring bias means.

4. A ram head as defined in claim 3, wherein said first spring bias means comprises respective springs which are guided in respective radial bores in said slide sleeve and which inwardly bias the respective said extraction levers relative to said holding ring.

5. A ram head as defined in claim 4, wherein said second spring bias means includes an axially extending spring for said plunger; a supporting plate for one end of said axially extending spring; and a tab on each of said levers for engaging and forming a friction lock with said supporting plate in response to a large extraction force.

6. A ram head as defined in claim 1, wherein said extraction levers are each provided with a respective tab for engagement with and actuation by said plunger.

7. A ram head as defined in claim 1, wherein said eccentric shaft has respective cams for axially moving said plunger and said ring, and three detent positions in which (a) said extraction levers and said slide sleeve are positioned inside of said housing with said levers spread, (b) said extraction levers are spread and said centering ring of said slide sleeve and said extraction levers extend axially at least partially out of said housing at its said front end plate, and (c) said centering ring of said slide sleeve and said levers extend at, least partially out of said housing at its said front end plate, and said extraction levers are unspread and in a gripping position.

8. A ram head as defined in claim 1, further comprising slide rails extending in the axial direction disposed at least at an underside of said housing.

9. A ram head as defined in claim 8, further comprising spring means for biasing said slide rails radially outwardly so that they can be pressed inwardly against a spring bias.

10. A ram head as defined in claim 9, wherein said spring means for biasing said slide rails comprise springs which permit said slide rails to be pressed inwardly on one or both ends.

11. A ram head as defined in claim 10, wherein said housing is provided with at least one plastic slide surface at its top side.

* * * * *